US005473928A

United States Patent [19]

Teitzel

[11] Patent Number: 5,473,928

[45] Date of Patent: Dec. 12, 1995

[54] TOOL AND METHOD FOR STRAIGHTENING A PANEL

[76] Inventor: Frederick E. Teitzel, 14611 3rd Ave. SW., Seattle, Wash. 98166

[21] Appl. No.: 228,191

[22] Filed: Apr. 15, 1994

[51] Int. Cl.[6] ..... B21D 1/12

[52] U.S. Cl. ..... 72/457; 72/705

[58] Field of Search ..... 72/457, 705

[56] References Cited

U.S. PATENT DOCUMENTS

| | | | |
|---|---|---|---|
| 3,835,692 | 9/1974 | Hoffman | 72/705 |
| 4,026,139 | 5/1977 | Glaser et al. . | |
| 4,116,035 | 9/1978 | Malarsky . | |
| 4,930,355 | 6/1990 | Ishihara . | |

OTHER PUBLICATIONS

"Dent Fix", Mar. 1984; 8 pages.

*Primary Examiner*—Lowell A. Larson
*Attorney, Agent, or Firm*—Dean A. Craine

[57] ABSTRACT

A tool and process is provided for pulling a concave portion from a metal panel. The tool and process have a primary use of pulling dents from damaged panels of vehicles. The tool uses four independently hinged legs that are moved up and down by a central control screw and a continuous cable and pulley system. Each of the legs have a plurality of independently acting paired cutting members to hold an individual stud therebetween. The continuous cable also serves the functions of providing a profile of the original shape of the panel and triggering the cutting members to sever the studs. The process involves marking specific points of the dented surface; welding studs to the dented surface at the marked points; inserting the multi-legged tool down over the studs such that each stud is captured and held between a pair of cutting members; turning the screw to cause a lifting of the legs which causes the studs and dented surface to be lifted; lifting each stud upwards until a portion of the dented surface contacts against the cable; triggering the cutting members to sever the stud thereby providing an independent release of the tool from the stud; and finally, pulling up all of the dent until all of the studs are cut.

15 Claims, 7 Drawing Sheets

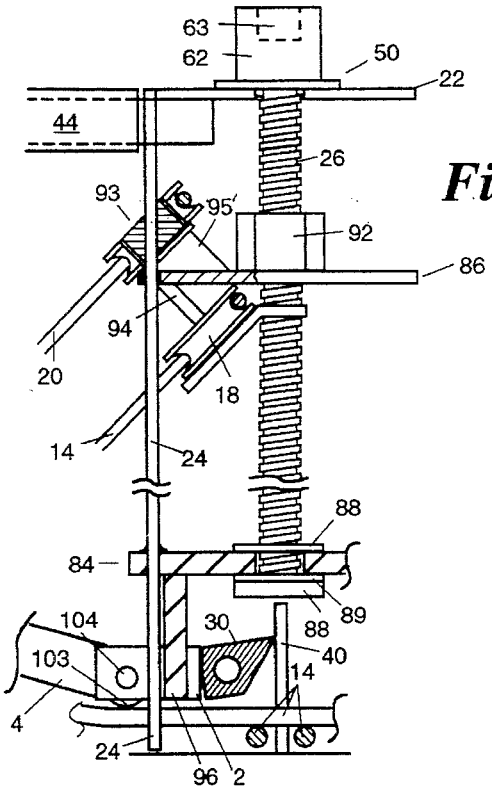
Fig. 10
Fig. 11
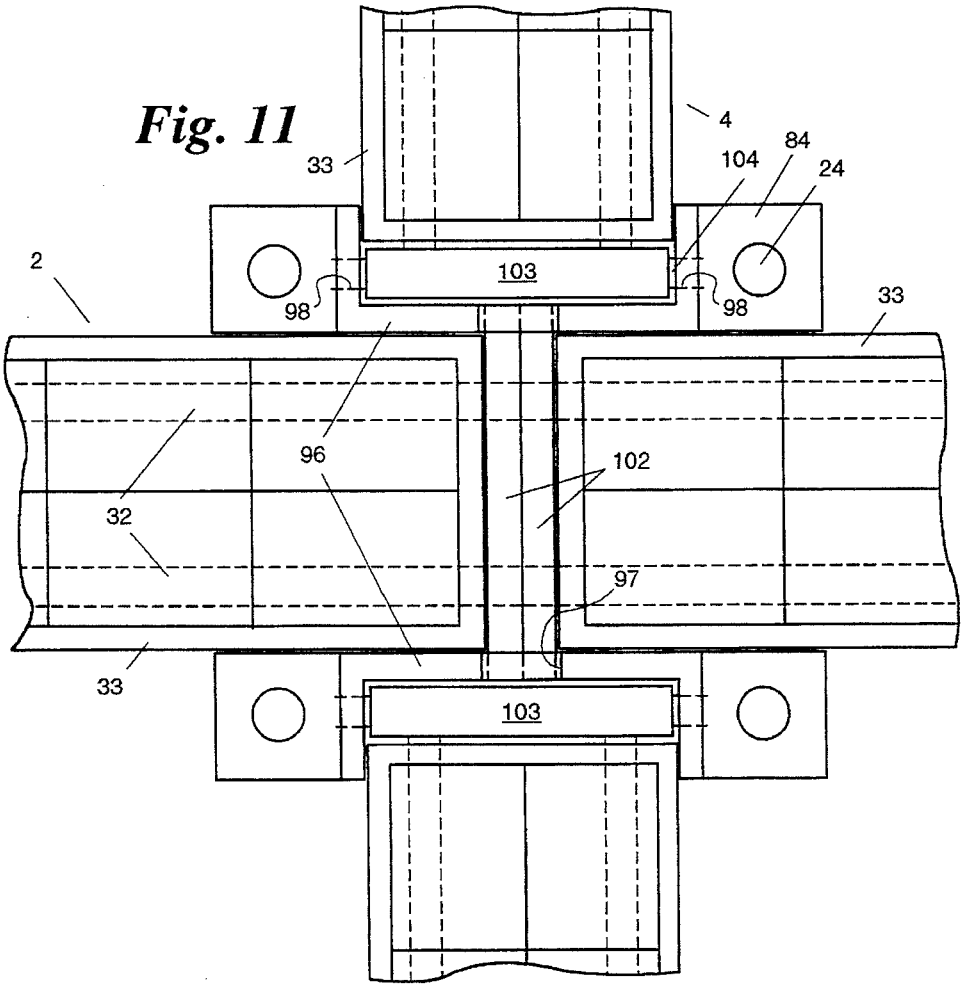

TOOL AND METHOD FOR STRAIGHTENING A PANEL

BACKGROUND OF THE INVENTION

The present invention relates to a tool for straightening panels, and specifically metal panels associated with vehicle autobodies. Such panels often become dented during automobile accidents. The most common practice in most auto body repair shops is to dispose of a panel that has any significant damage. One of the reasons for this wasteful practice is that the labor required to repair a dented panel often approaches or even exceeds the cost of a new, replacement panel. Also, the repaired panel often doesn't meet the customer's demand that the straightened panel look as good as new. The main problem associated with repairing a dented panel has been the lack of an efficient tool for assisting the autobody worker. Most tools used by autobody workers have been either rudimentary manual tools, such as hammers or mallets for pounding out the dents, or have been overly complicated tools that use non-conventional methods for pulling a dent from a panel.

U.S. Pat. Nos. 4,930,335, 4,116,035 and 4,026,139 to Ishihara, Malarsky and Glaser, respectively, show representative prior an tools with various linkages to pull a dent upwardly that are more complicated than rudimentary manual tools. These tools have not been widely used within the field of autobody repair work. A combination of tools, marketed under the name of Dent Fix, uses a welding gun to solder metal studs to the dented surface to be subsequently pulled by a manual slide hammer.

SUMMARY OF THE INVENTION

It is an object of this invention to provide a tool and method for straightening panels that automates the dent repair process, and efficiently pulls a dent flush with the surface of the panel.

Another object of the invention is to provide a tool and method that can preserve the original panel with a minimum of labor involved in repairing the panel to result in a significant cost savings over the practice of disposing of the damaged panel and replacing it with a new panel.

It is a further object of the invention to provide a tool and method that may be applied in a wide variety of applications which could include dramatically curved panels and large panels having large dents.

Other objects of the invention will be apparent hereinafter from the specification and from the recital of the appended claims, particularly when read in conjunction with the accompanying drawings.

The present invention comprises a cross shaped cutting tool that has plural pairs of cutting members mounted along each leg of the cutting tool. The cutting members are mounted for pivotal rotation between a pair of frame members. The outer ends of the frame members have wheel assemblies connected thereto that allow each leg end to roll freely across the surface of a panel, during the operation of the tool. Two of the legs are substantially arranged along an X-axis, while the other two legs are generally perpendicular to the first two legs and are substantially arranged along a Y-axis. All four legs are mounted at their respective inner ends for pivotal movement relative to a central transfer assembly that is positioned along a vertical or Z-axis relative to the X and Y axes. One strut extends inwardly from each of the leg ends, and another four struts extend outwardly from the transfer assembly. These eight struts have pulleys at their outer ends to cooperate with corresponding pulleys upon the transfer assembly and at each of the wheel assemblies to form a pathway for a continuous primary cable. The transfer assembly includes a large helical screw that, at one end, pulls the inner ends of the legs upwardly in response to the turning of a control socket, at the screw's opposite end. The transfer assembly also includes a platform for mounting eight of the aforementioned pulleys. A sling is provided upon an upper platform of the transfer assembly to hold a wrench for turning the control socket.

The tool is used to achieve the method of straightening the panel. Initially, a plurality of studs are welded to a dented surface along an X and Y axis. This can be achieved by a conventional stud welding gun. The positioning of the studs on the panel can be assisted by the use of a magnetic template formed in the shape of a cross. The tool is then positioned over the studs by pushing the studs up between the frame members so that one of the many pairs of cutting members catch the stud between the complimentary pair of cutting members. Each of the cutting members is spring biased toward its opposite paired cutting member so that the stud is firmly held between the cutting members. Once the tool is positioned over the studs, the control socket of the tool is rotated by a wrench which causes the inner ends of the legs to lift upwardly. At the same time, the pulleys mounted upon the transfer assembly descend upon the central screw which causes the primary cable to push the outer ends of the legs downwardly. By the motion of the legs, the studs are also pulled up, as well. Once, the studs are pulled far enough so that the panel returns to its original contour, the primary cable, stretched across the surface of the panel, will not allow the studs to be pulled any further. At this point, the cutting members are automatically pushed together at such an extreme force that the studs are cut. When all studs welded to the dented surface are cut, the panel has been straightened to its substantially original form.

There are many operational advantages to the use of the tool and process of the present invention in pulling a concavity, or dent, from a metal panel that have not been heretofore achieved by any other prior art tool or process. First, the tool and process of the present invention involves the independent release of the panel as it is being pulled upwardly at plural distinct points. As the studs are being pulled upwardly, an independent release of each stud is achieved due to the independent acting cutting members and the flexible cable member. Each pair of cutting members act as a connecting member to the stud, and the severing of the stud will release the cutting member, and the tool, from the stud once the panel surrounding the stud contacts the cable. This disconnection occurs for a single stud, independently of any other stud that has yet to be pulled up to the cable.

A second operational advantage involves a delayed release of the connecting member with the stud. Once the stud has pulled a portion of the dent upwardly until it contacts the cable, the release of the stud isn't achieved immediately. Instead, the time that it takes to sever the stud by the cutting members causes the release to be delayed for a predetermined timespan. During this timespan most of the metal surrounding the stud is held in place, and a small amount of metal will draw into a small bump extending slightly between parallel portions of the cable. This contributes to the stabilization of the metal. The stabilization of the metal will prevent the panel from springing back once the stud is released. Furthermore, the stabilization will minimize the amount of secondary work that is often required when repairing metal panels, e.g. heat shrinking. The delayed release can be adjusted by changing the shape and cutting angle of the cutting members.

A third operational advantage involves the use of independently hinged legs on the tool. The independent movement of these legs allow for a wide variety of pulling applications. The legs are able to adapt to deep dents, irregular angles upon the panel, dramatically curved surfaces, etc.

There are several other unique operational advantages associated with the use of a flexible cable to act as a flexible base member for the tool to pull the panel up to. First, the cable acts as a template of the surface of the panel. Since the cable has the ability to bend, the cable can emulate a curved surface. Use of a modified cable with a spliced stretchable portion would allow the stretchable portion to even further conform to a curved surface and better provide a curved template for the tool. The cable, or template, becomes a profile of the surface during the pulling process.

A second advantage of the flexible cable is that it triggers the release of the cutting members, once an individual stud has pulled a portion of the dent up into contact with the cable. As mentioned earlier, the triggering function of the cable allows the independent release of the studs. The automatic triggering of the release of each stud allows the tool to be used with very little skill by the user.

A third advantage of the flexible cable when used in conjunction with a multi-legged tool of the invention is that it spreads the pulling force substantially evenly across all of the legs of the tool. Furthermore, the cable combined with a multi-legged tool allows the flexible cable acting as a base member or template to be positioned down inside a dent at the beginning of the pulling process. If the base member were rigid, such a capability would not be possible.

A fourth advantage of the cable is that it operatively acts to push the ends of all of the legs down to the surface of the panel, and allows the tool to adapt to a wide variety of flat, curved, stepped and angled panels.

A final advantage of using a cable in the tool and process of the present invention is that the cable acts to transfer the pulling resistance in a continuous line from the edge or perimeter of the dent out to the ends of the legs. There are no feet that bear a large force directly against the undamaged portion of the panel, nor against any adjacent undamaged panel, as is done in prior art tools. Instead, the cable acts to transfer the pulling force evenly across all of the area where the cable contacts against the panel. Initially the cable only contacts the dent perimeter which is highly resistant to a large pulling force. As the pulling process proceeds onwardly, the cable stretches out across the panel and transfers the pulling force evenly across the undamaged portions of the panel. The wider panel area that the pulling force is transferred to will minimize or prevent any damage from occurring throughout the pulling process. Furthermore, since the roller assemblies of the present invention do not bear a large force against the panel, as do the feet of the prior art tools, an adjustment mechanism of the roller assemblies is not necessary.

BRIEF DESCRIPTION OF THE DRAWINGS

FIG. 10 shows a partial cross section of the transfer assembly of the tool of FIG. 1.

FIG. 11 shows a detailed bottom view of the connection of the inner ends of the legs to the transfer assembly of the tool of FIG. 1 which is formed as a four-way hinge.

DETAILED DESCRIPTION OF THE INVENTION

Figure 1:
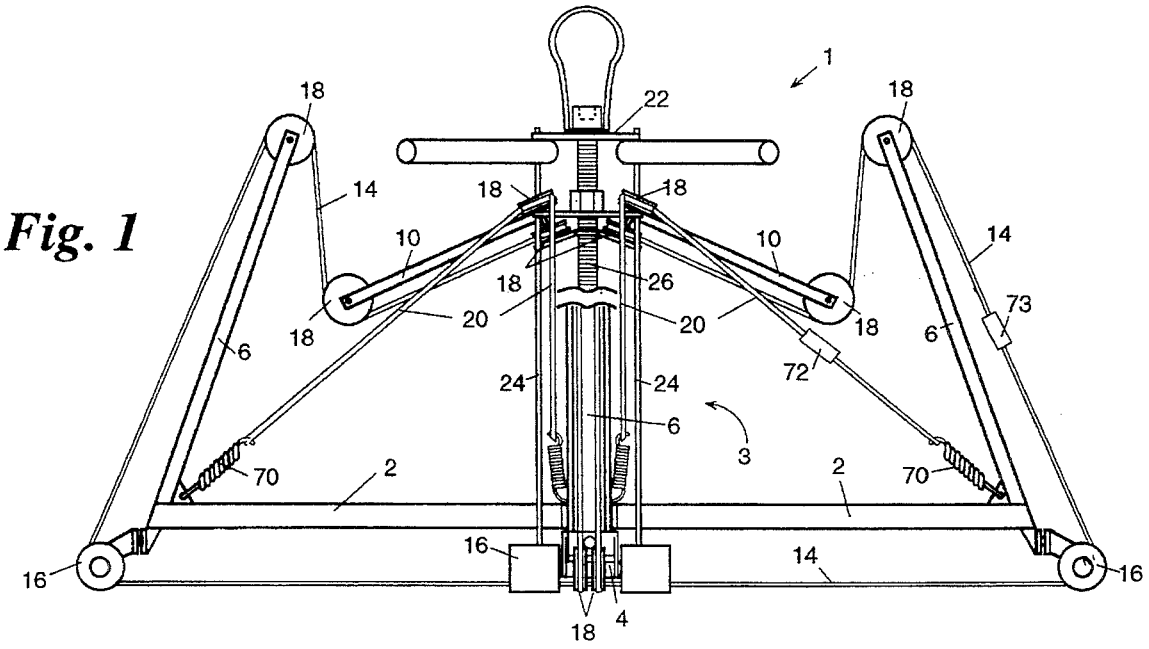
FIG. 1 shows a first side view of the tool of the present invention with the longitudinally wide dimension of the figure representing the X-axis of the tool.
Figure 2:
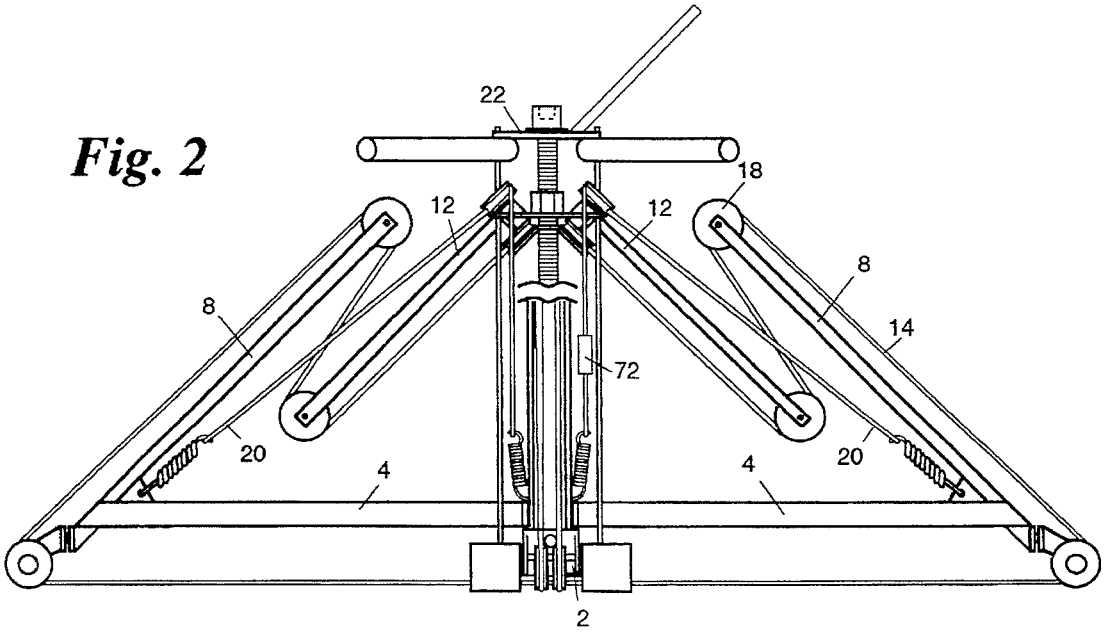
FIG. 2 Shows a second side view of the tool of FIG. 1 with the longitudinally wide dimension of the figure representing the Y-axis of the tool.

FIGS. 1 and 2 show two different side views of the tool 1, the orientation of FIG. 1 being normal to the orientation of FIG. 2. The tool includes a pair of hinged legs 2 arranged generally along an X-axis, a second pair of hinged legs 4 extending perpendicular to the hinged legs generally along a Y-axis, and a central transfer assembly arranged vertically, or along a Z-axis when viewed in FIGS. 1 and 2. Angled struts 6 extend upwardly from the outer ends of the X-legs 2, while more dramatically angled struts 8 extend upwardly from the outer ends of the Y-legs 4. Similarly additional X-struts 10 extend downwardly from the transfer assembly while dramatically angled Y-struts 12 also extend downwardly from the transfer assembly. The outer ends of the X-legs 2 and Y-legs 4 have wheel assemblies 16 that are identical to one another and form the four corners of the tool. Each of the wheel assemblies include pulleys (not seen in these views). The ends of all struts, as well as an intermediate platform of the transfer assembly have pulleys 18 which form a guide for a continuous primary cable 14. The cable acts as the tensioning and triggering mechanism of the present invention.

Four separate secondary cables 20 stretch between two corners of the tool across an additional pulley mounted upon the transfer assembly. The secondary cables provide an adjustment mechanism for keeping the primary cable properly tensioned, and provide overall balance to the tool. The secondary cables also serve to bias the ends of the legs 2 and 4 upwardly. As discussed above, the primary cable 14 is the mechanism by which the pulling force is transferred to the panel during the pulling process. However, if the legs 2 and 4 are allowed to exert a downward force upon the panel, the ends of these legs (wheel assemblies 16) will also transfer some of the pulling force to the specific areas where the ends of the legs bear against the panel. To minimize the impact of the ends of the legs against the panel, the secondary cables are used to provide an upward bias to the ends of the legs. Through the bias of the ends of the legs, the secondary cables also serve their initial purpose of keeping the primary cable properly tensioned. An adjuster 72 can be provided to each of the secondary cables to allow the tensioning of the primary cable to be adjustable. The adjuster is a conventional cable tightening mechanism, such as a turnbuckle, of which details are not herein discussed. An alternative way to adjust the primary cable 14 would be to provide the primary cable with a similar adjuster 73. Such adjustments of the cables are also necessary as the cables wear with repeated use.

The primary cable can also be constructed to allow longitudinal stretchability. A cable that has an ability to stretch to a predetermined length would allow the cable to better conform to a curved surface than a conventional cable with limited stretchability. If the primary cable 14 is provided with the ability to stretch. The adjusters 72 and 73 would be used to vary the predetermined level of stretch by pre-stretching the cable in preparation of the tool's use. The level of stretchability would be determined by the gauge of metal being pulled, depth of dent, and/or the curvature of the panel. A final purpose of the secondary cables 20 is to keep the tool tensioned in a generally static position, even when the tool is not in use, or is merely in transport. Without the secondary cables, the primary cable and the four hinged legs would flop around and be difficult to handle.

The transfer assembly comprises an upper control platform 22, a central helically threaded screw 26, and support posts 24. The end of the screw is attached to a lower platform (not seen in FIGS. 1 and 2) that forms a mount for pivotally attaching the inner ends of X and Y legs 2 and 4 to the transfer assembly. The function of the transfer assembly is to move the inner ends of the legs up and down due to the hinged attachment of the inner ends to the bottom of the screw, and to move the outer ends of the legs up and down due to the motion of the continuous cable. Under some pulling applications, a greater length of the continuous cable will transfer from the X-legs to the Y-legs, and vice versa. The ability of the cable and pulley system to transfer between these legs gives the tool further flexibility in a wide range of repair applications. Further details of the transfer assembly will be explained below.

Figure 3:
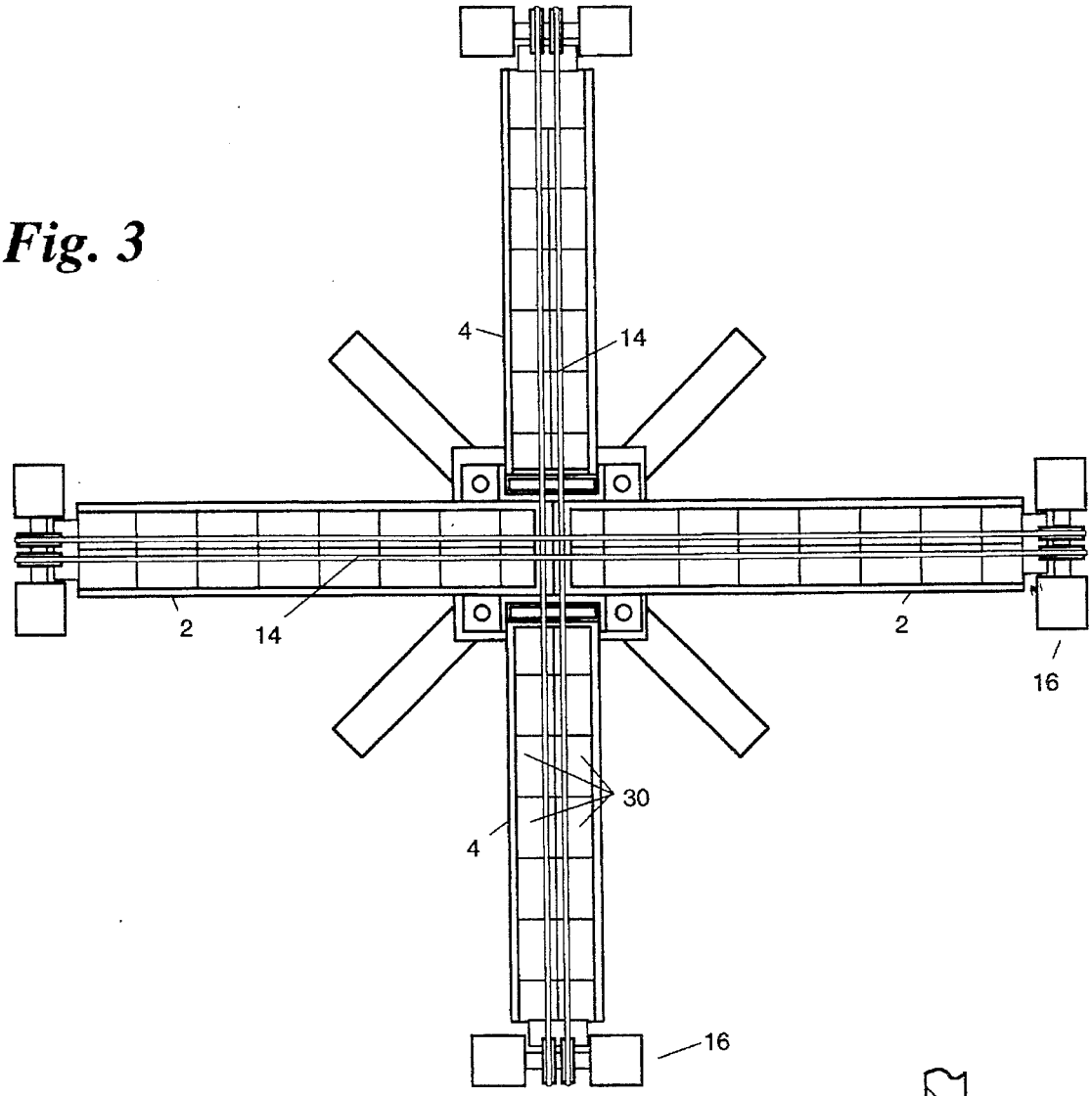
FIG. 3 shows a bottom view of the tool of FIG. 1.
Figure 4:
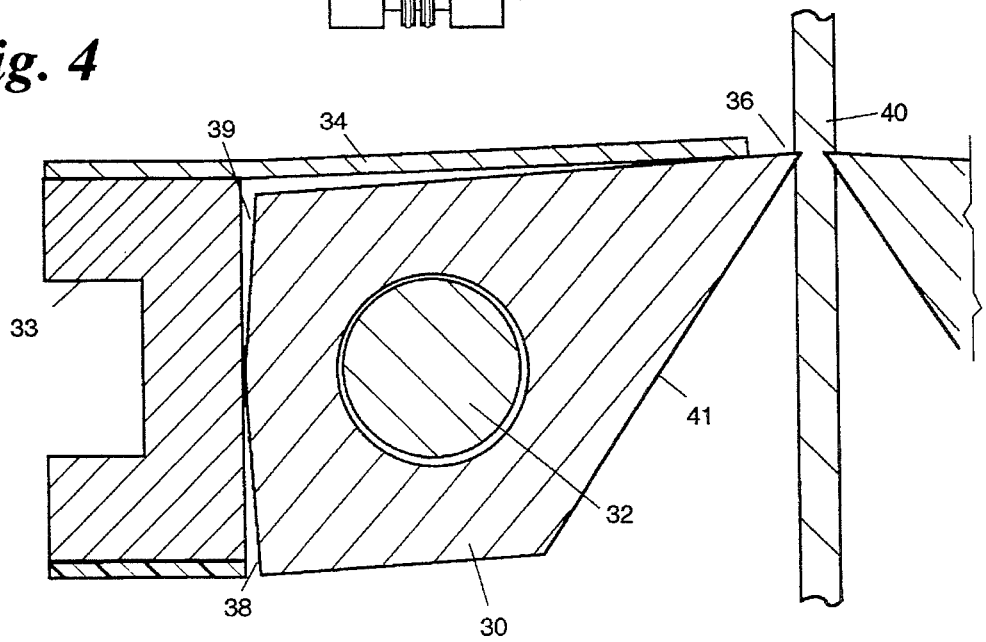
FIG. 4 shows a cross sectional view of the cutting members of the tool of FIG. 1.

FIGS. 3 and 4 reveal details of the cutting members 30 of the tool. The cutting members are formed in pairs across the entire length of the legs 2 and 4. The pairs of cutting members are mounted between two longitudinally extending frame members 33 which span the full length of each leg 2 and 4. Each cutting member is mounted for rotation about a cylindrical rod 32 which also spans the length of each leg. The cutting members rotate independently of one another, but are normally all biased downwardly by a leaf spring 34. In the normally biased position, a back surface 38 of the cutting member will abut against an outer surface of the frame member 33. As the tool is pushed down over the stud 40, the top of the stud (not seen in FIG. 4) pushes against the angled camming surface 41 of the cutting member, and positions the stud at the proper position directly between a pair of cutting members. At this point, both of the cutting members begin to rotate against the bias of the springs until the stud is caught between the cutting edge 36 of each of the pair of cutting members, as shown. The cutting member has another angled back surface 39 which will abut against the outer surface of the frame member 33 to limit the rotation of the cutting member for proper positioning of the cutting edge 36 on the stud 40. In the position shown in FIG. 4, the cutting members can be pushed further down upon the stud 40 so that the cutting edge 36 frictionally slides against the outer surface of the stud; however, the angled orientation of the cutting edge 36 of the cutting member prevents the tool from being pulled upwardly upon the stud. Movement of the inner ends of the legs 2 and 4 upwardly causes the cutting edge of each of the pair of cutting members to dig into the outer surface of the stud, as shown. It is this one-way direction of movement of the cutting members 30 relative to the stud 40 which allows the tool to pull the stud upwardly which consequently pulls the surface of the panel upwardly.

Figure 5:
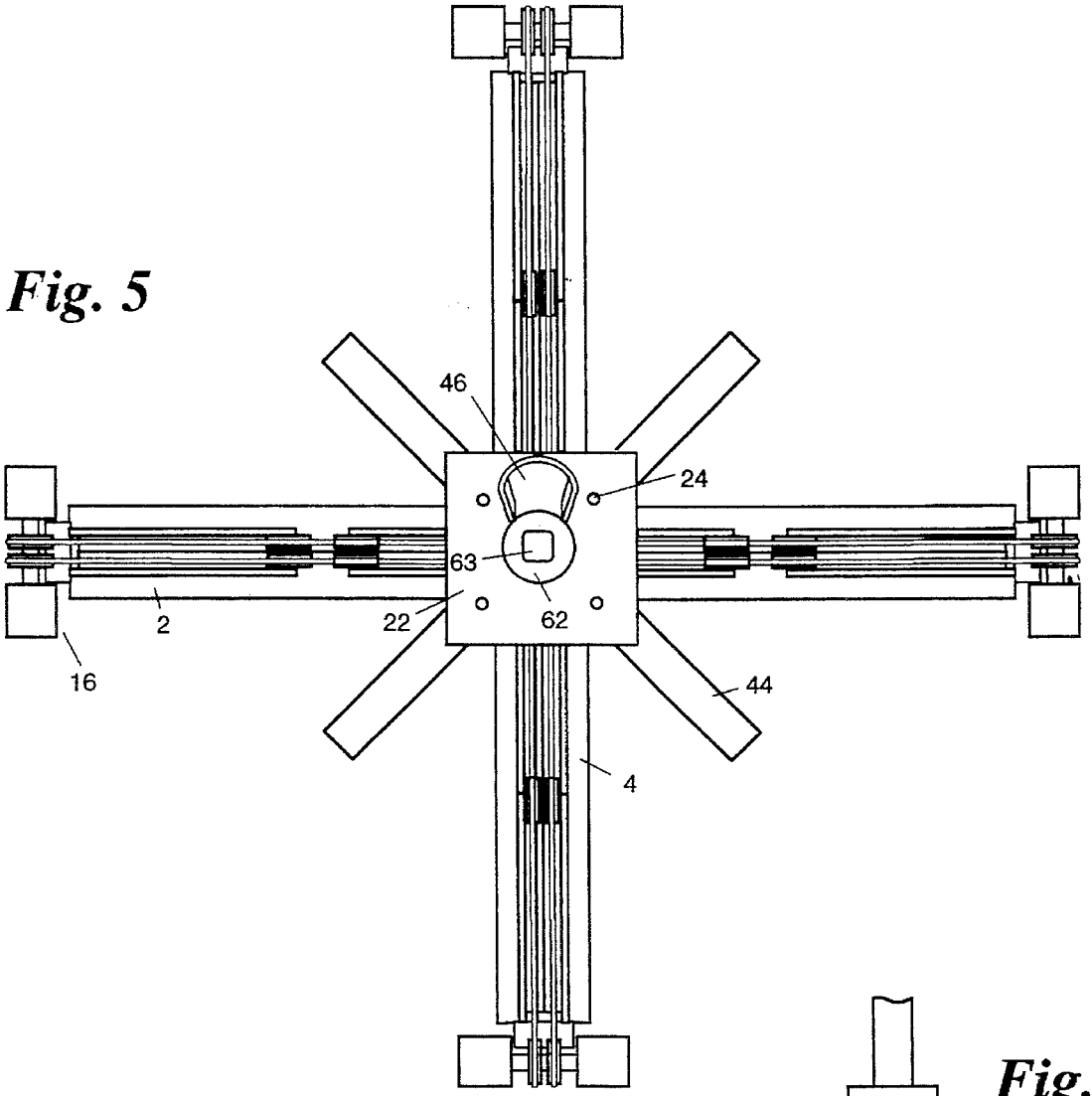
FIG. 5 shows a top view of the tool of FIG. 1.
Figure 9:
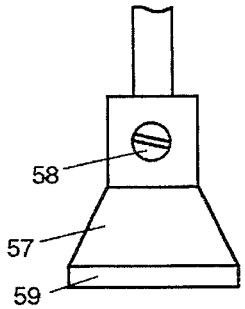
FIG. 9 shows an end view of the operative attachment shown in FIG. 7.
Figure 6:
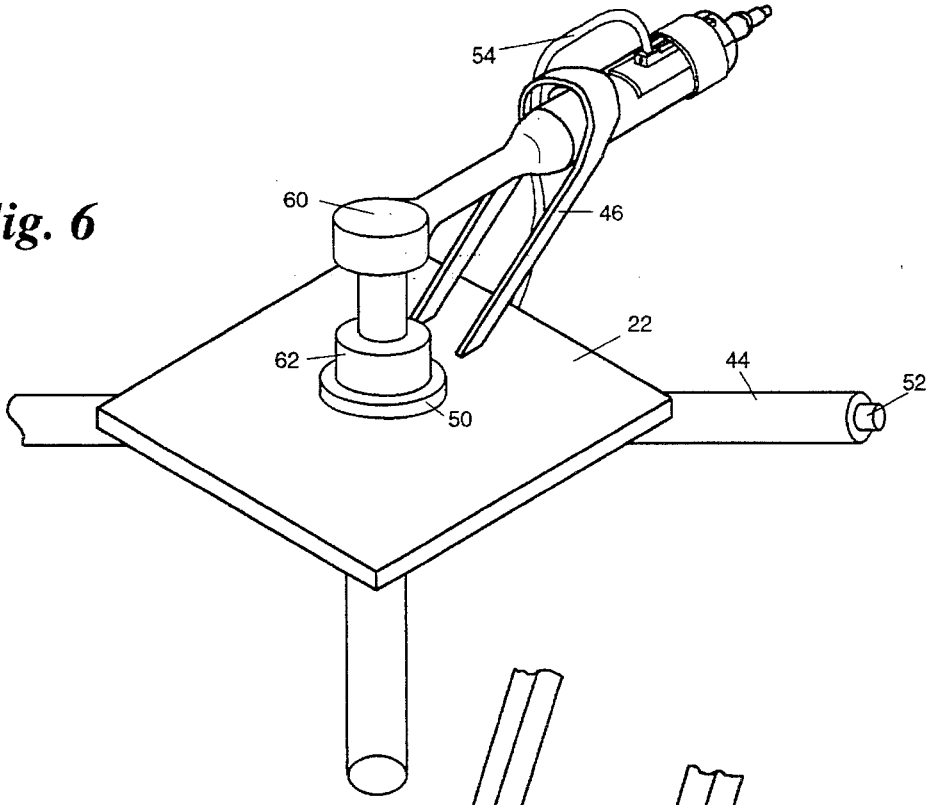
FIG. 6 shows a perspective view of the upper control platform of the transfer assembly of the tool of FIG. 1.

FIG. 5 shows a top view of the tool to reveal the control platform 22. A sling 46 is shown for holding a wrench that may cooperate with a socket 62 for controlling the up and down motion of the legs. Four handles 44 are rigidly attached to, and extend outwardly from the four corners of the platform. The handles provide a means for the operator to firmly grasp and balance the tool as the tool is pushed down over the studs and throughout the dent pulling process. Further details of the control platform 22 may be seen in FIG. 6. The wrench 60 may be connected to the socket 62 which is rigidly attached to the top of the helical screw 26. The connection between socket and wrench is a conventional square recess 63 and a square projection (not shown) on the socket and wrench, respectively. FIG. 6 shows the handle of the air wrench 60 extending through the sling 46.

Figure 7:
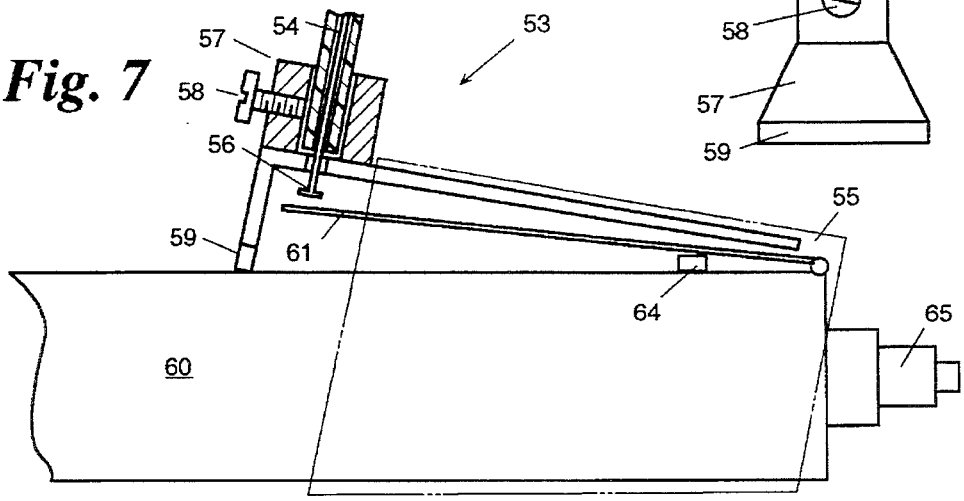
FIG. 7 shows details of an operative attachment to the wrench shown in FIG. 6.

FIG. 7 shows the handle of the wrench 60 with an operative attachment assembly 53 connected thereto. The cable link 54, shown in FIG. 7, is operated by the depression of the trigger 52 at the end of one of the tool handles 44, shown in FIG. 6. Depression of the trigger will cause the cable end 56 to push upon a pivot link 61 which is in contact with a control button 64 of the air wrench, The operative attachment assembly is attached to the handle of the wrench 60 by a strap 55 in a conventional manner, i.e. long opposed strips of Velcro® patches on opposite sides of the strap. The outer casing of the cable link 54 is attached to a cable support 57 which includes a screw 58 for firmly attaching the cable link to the attachment assembly. A rubber foot 59 at one end of the cable support prevents the attachment assembly from slipping upon the handle of the wrench 60. The pivot link 61 and control button 64 are parts of the air wrench, as is the air inlet 65. Since the cable link is attached to the air wrench, the depression of the trigger thereby causes the air wrench to start-up and begin turning the control socket 62 of the tool.

Figure 8:
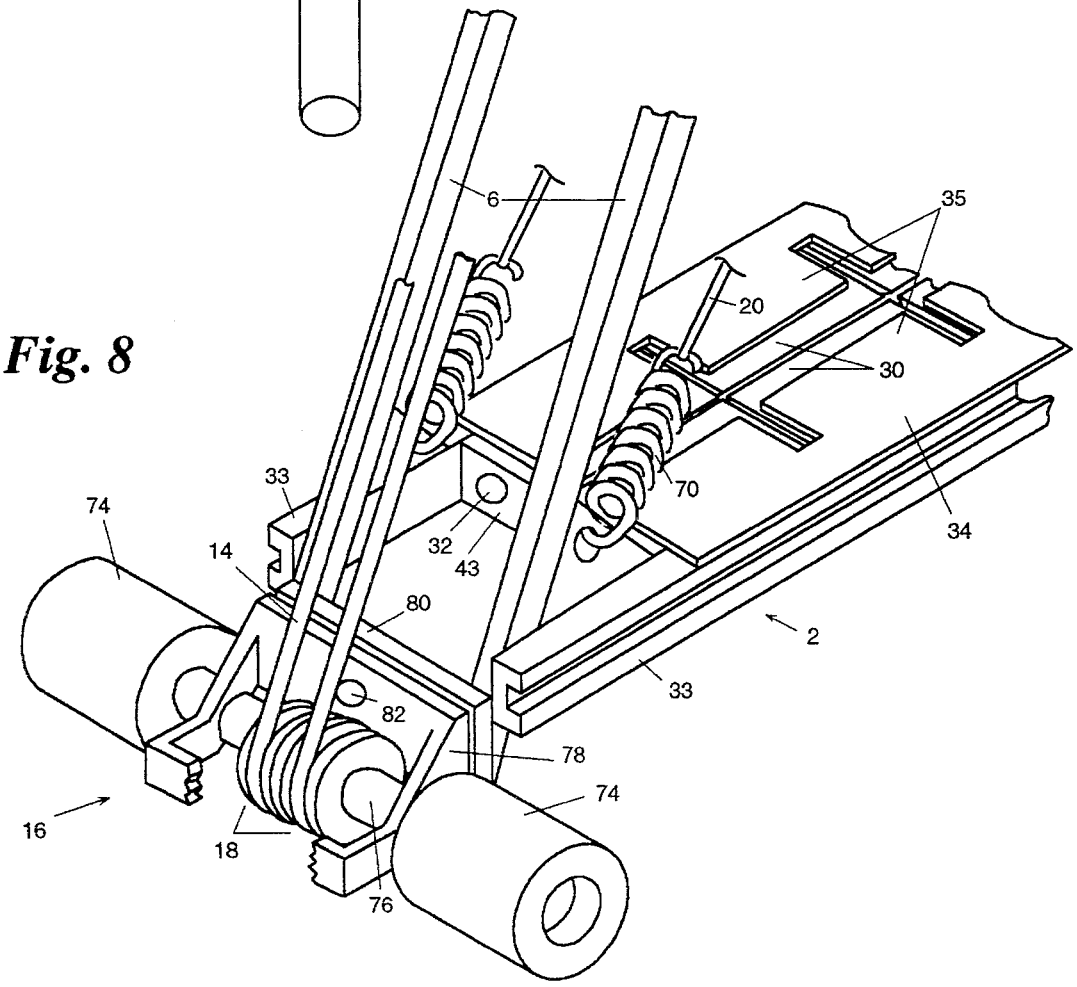
FIG. 8 shows a partial perspective view of the wheel and pulley assemblies at the ends of each of the legs of the tool of FIG. 1.

Details of the wheel assembly 16 of the tool can be seen in FIG. 8. An end member 80 is directly welded to the angled struts 6 and the two channel members 33 between which are mounted the cutting members 30, This view shows the leaf springs 34 as having a generally comb-like shape having individual tongs 35 for biasing a single cutting member. An individual tong of the leaf spring will act relatively independently of the other tongs to bias the single cutting member to a downwardly rotated position, as shown. Tension springs 70 are fastened to a hole in a plate that forms the junction between the angled struts 6 and the channel members 33. The tension springs form the ends of the tension cables 20 shown in FIG. 1. An end wall 43 extending between the frame members 33 forms a mount for the ends of the elongated hinge rods 32. Another end wall supports the rods 32 on their opposite ends (see FIG. 11).

The wheels 74 are mounted for rotation about an axle 76 which also forms a support for the rotation of the end pulleys 18. The axle is mounted within an axle support 78 that is connected to the end member 80 by a pivot pin 82. This pivoted connection allows the entire wheel assembly to rotate at the end of each leg. The rotating capability of the wheel assemblies allows the wheels to adapt to a non-flat panel while keeping the legs in their proper location during the pulling process.

FIG. 10 shows details of the cable transfer assembly of the present invention. The transfer assembly consists of three platforms: a control platform 22 located at the top of the tool, a leg joint platform 84 located at the bottom of the tool, and a pulley platform 86 located in between the control platform and leg joint platform. The three platforms are linked together by the central helical screw 26 and support posts 24. The support posts are rigidly attached at opposite ends to the control platform and leg joint platforms. Additionally, the support posts are slidably disposed within holes formed in the corners of the pulley platforms. The end of screw 26 is connected to the leg joint platform between a pair of washers 88. A bearing 89 is disposed between the lower washer 88 and the underside of the leg joint platform to allow the screw to freely turn within the leg joint platform, but preventing the screw from sliding longitudinally relative to the platform 84. At its upper end, the screw extends through a central hole within the control platform 22, and has the control socket rigidly attached thereto. The connection of the screw 26 to the pulley platform 86 is a direct threaded connection between the external threads of the screw and internal threads of an integral nut 92 that is formed with or welded to the pulley platform. The threaded attachment of the pulley platform with the screw is the operative connection that drives the motion of the inner ends of the X and Y legs 2 and 4 of the invention. A series of spindles 94 are mounted along four corners of the platform upon which four separate pulleys 18 rotate. Another four pulleys 18 are mounted upon triangular supports 95 which forms four bases upon which these upper pulleys rest. Extending upwardly at an angle from the triangular support is a wide spindle 93 upon which the upper pulleys 18 rotate. FIG. 10 shows support post 24 extending through a bore within the spindle 93 to help support the spindle. As explained previously, the pulleys mounted above the platform provide guides for the tension cables 20, while the pulleys mounted below the platform provide guides for the continuous primary cable 14.

The bottom of FIG. 10 depicts the spatial relationship between the cutting members, cable, and transfer assembly. Specifically, the arms 2 and 4 are pivotally mounted upon a downwardly extending flange 96 of the leg joint platform. Leg 4 is shown to rotate upon a hinge pin 104. A sleeve member 103 is disposed around the hinge pin 104. The function of the sleeve member is to frictionally abut against the primary cable 14. One operational aspect of the invention is that the parallel portions of the cable may be manually separated prior to pushing the tool down over the studs which are welded to the dented panel. This is done to ensure proper cable placement on either side of the studs. When the cable is separated, there is enough friction between the cable and the sleeve members 103 to maintain the normally parallel portions of the cable apart long enough for the tool to be inserted down over the studs. Another two parallel portions of the cable (shown in cross-section in FIG. 10) lie beneath the two upper portions of the cable. The lower portions can be frictionally held by the upper parallel portions in a similar manner to the frictional hold between the upper parallel portions and the sleeve members 103 when manually separated. Thereafter, rotation of the screw will cause the upper and lower portions of the cable to be pulled back to their parallel configurations. The cutting member 30, shown in FIG. 10, depicts how the cutting members of leg 2 extend all of the way beneath the leg joint platform 84. Although support posts 24 are welded to the leg joint platform, extensions of the support posts extend downwardly through s holes within the platform to act as feet for the tool to rest upon.

Once the tool has been positioned over the studs, the operation of the tool involves turning the control socket 62 which causes the screw 26 to turn. Since the leg joint platform is connected to the end of the screw, this platform moves up and down with the screw. Turning of the screw will cause the screw to move up and down (depending upon the direction of the turn) relative to the pulley platform. It should be noted that during the operation of the tool, the pulley platform remains at a generally even plane as the legs 2 and 4 are moved up and down by the cable 14 and the screw 26.

FIG. 11 shows a bottom view of the transfer assembly, and specifically the hinged attachment of the legs 2 and 4 to the leg joint platform 84. The X-legs 2 are connected to the platform by hinge pins 102 that me connected to the ends of the frame members 33. The ends of the hinge,pins 102 reside within openings 97 formed in a downward depending flange 96 of platform. The flange 96 is U-shaped with the openings 97 residing in the base portion of the U. A second set of holes 98 are formed within the legs of the downward depending flange, and these second set of holes 98 cooperate with hinge pins 104 to pivotally mount the Y-legs 4. As mentioned above, sleeve members 103 are mounted upon the hinge pins 104 Similar to the hinge pins 102, the hinge pins 104 are rigidly connected to the end of the frame members 33 which are a part of Y-legs 4. The hinges 102 and 104 allow the inner ends of legs 2 and 4 to freely rotate about the leg joint platform 84. These hinged inner ends of legs 2 and 4 move up and down concurrently with the motion of screw 26 since the platform is connected to the end of the screw. It should be appreciated that the movement of the outer ends of legs 2 and 4 are controlled by the continuous cable 14 that crosses beneath the wheel assemblies at the ends of the legs.

The unique method for straightening a panel defined by the present invention can best be described with reference to FIGS. 12–20. The method corresponds to the operation of the tool described above and depicted in FIGS. 1–11. Thus, FIGS. 12–19 are shown in schematic form to avoid unnecessary clutter within these sequential views. The structure of the tool remains the same in these schematic views. For example, in FIGS. 12–16 the schematic representation of the tool includes the central screw 26 of the transfer assembly, the pulleys 18, the continuous primary cable 14, the wheel assemblies 16, and the X-legs 2. In the 90° side view depicted in FIGS. 17–19 the various parts of the tool are the same, except that in this view the Y-legs 4 are depicted.

Figure 21:
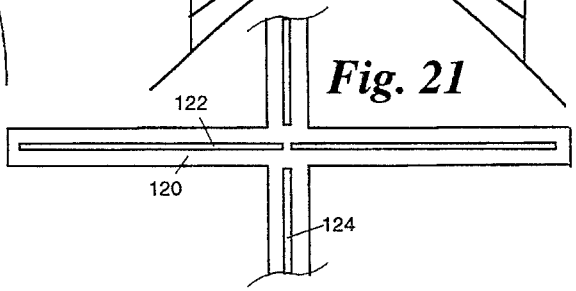
FIG. 21 shows an example of a template to be used in the method of straightening a panel depicted in FIGS. 12–19.

The method of the present invention involves straightening panel 110 having a dent 112. This panel is shown to be dramatically curved to illustrate the effectiveness of the tool and method of the present invention on non-flat surfaces. It should be appreciated that an actual panel having the same curvature of the depicted panel could be actually repaired using the tool and method of the present invention. The first step of the method involves marking the panel. For this purpose, the present invention includes the use of a marking template shown within FIG. 21. The template is a cross-shaped flexible member and corresponds in dimensions to the X and Y legs 2 and 4 of the tool. Slots 122 and 124 extend across the two lengths of the template to allow the panel 110 to be marked where the studs are to be welded to the panel. The template can include a magnetic or adhesive bottom so that it adheres to the panel, and does not move during the marking step. Markings can also be made around the periphery of the template. Such additional markings can provide a sighting assistance for the user to position the tool properly.

Figure 20:
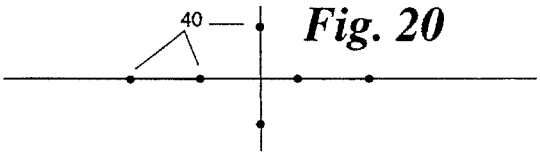
FIG. 20 shows a stud pattern upon the dented surface depicted in FIGS. 12–19.

Once the marking has been completed, the template is removed and studs 40 are welded to the panel at the marking points. FIG. 20 shows the cross shaped pattern of studs welded to the panel 110. It is important that these studs are aligned within a cross shape, so that any of the four legs 2 and 4 of the tool can align properly with all of the studs. It should be appreciated that exact positioning of the studs relative to the tool along the two perpendicular lines is not critical because the tool has independent acting cutting members along all four of the legs.

Figure 12:
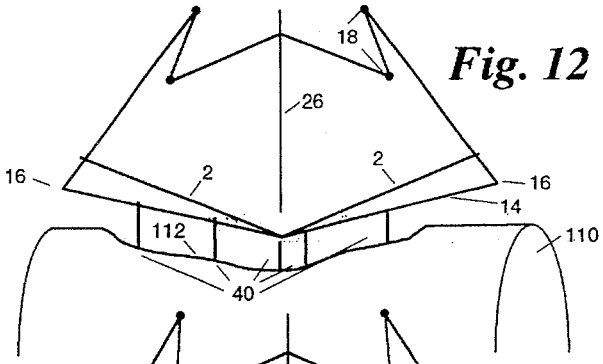
FIGS. 12–16 show schematic sequential views of the operative steps involved in the method of straightening a panel using the tool of the present invention.
Figure 13:
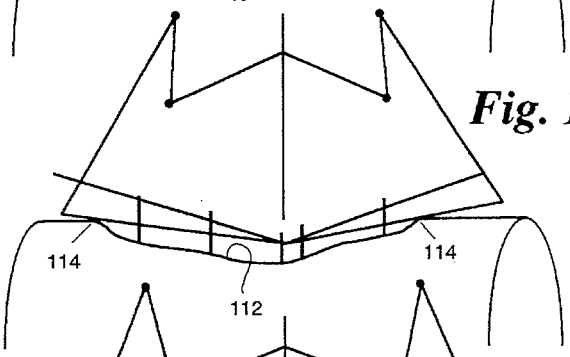
Figure 17:
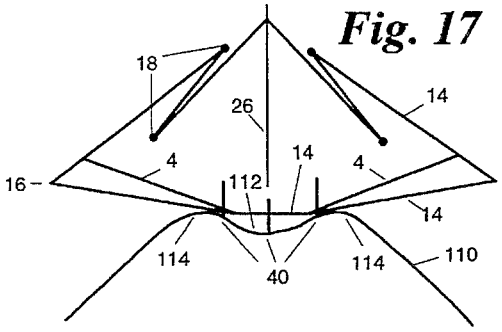
FIGS. 17, 18, and 19 show schematic side views corresponding to a perpendicular orientation from the views shown by FIGS. 13, 15, and 16.

After the stud welding step, the tool is then positioned down over the studs. FIG. 12 shows the first of five sequential views of the tool in relation to the panel. In FIG. 12 the leg 2 is in the process of being positioned down over the studs. As described previously in the description of FIGS. 3 and 4, the underside of the cutting members include a camming surface to automatically force a single pair of cutting members apart, against the bias of the leaf spring, for each of the studs 40 welded within the dent 112 of the panel. Just prior to the cutting members opening up, the parallel portions of the continuous cable 14 will straddle the studs. As the tool is pushed down further toward the panel, the ends of the support posts 24 eventually contact the bottom of the dent. Then, as the socket is turned the cable comes into contact with the peripheral edge 114 of the dent as seen in FIG. 13. FIG. 17 shows the Y-direction view of the panel and tool with the cable contacting the peripheral edges of the dent. On a steeply pitched concave panel the wheel assemblies 16 at the corners of the Y legs 4 do not physically touch the panel at the beginning of the tool operation, as shown in FIG. 17. This invention is unique in that the ends of the legs do not exert any significant pressure against the undamaged portion of the panel. It is the cable 14 that spreads the resistance created in pulling the dent, across the surface of the panel.

Once the tool is fully positioned upon the studs 40 within the central part of the dent, the screw 26 is turned by the operator causing the inner ends of legs 2 and 4 to lift upwardly while the cable 14 pushes the outer ends of the legs (defined by the wheel assemblies 16) downwardly. It should be noted, that with very broad and shallow dents, the studs towards the periphery of the dent need not initially be projecting up through the cutting members. Instead, continued turning of the screw will cause the outer ends of the legs to eventually push down over these studs. While the legs 2 and 4 are lifted, the cutting members are gripping the studs which exerts a force to pull the dented portion of the panel upwardly. In every conventional dent pulling tool, this force is transferred to the ends of linkages that contact the undamaged portion of the panel which can cause further damage to the panel. But, as mentioned above, this force is transferred evenly by the cables to the panel. In FIG. 13 it can be seen that the force is being transferred to the peripheral portion 114 of the dent, also known as the crease. The crease of the dent is the strongest point of the dent and can easily handle the force generated by the pulling of the dent.

Figure 14:
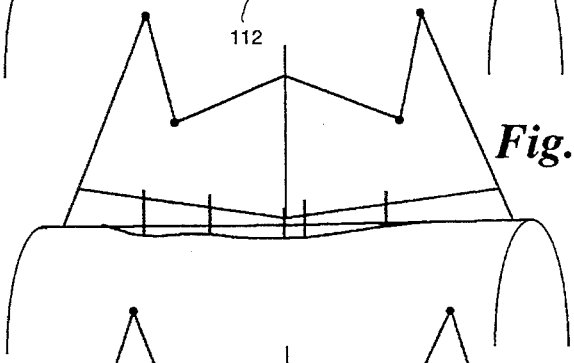
Figure 15:
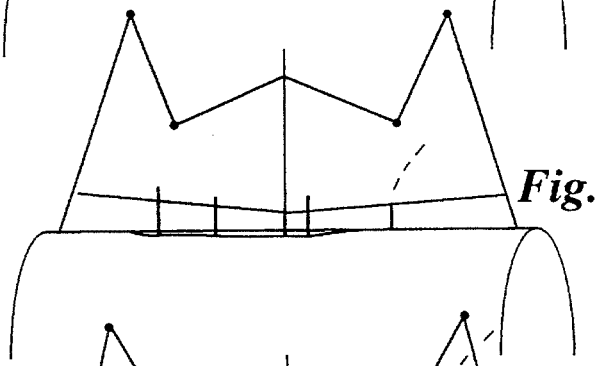
Figure 18:
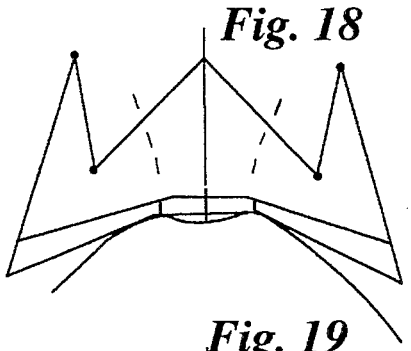

As the dent is further pulled, as shown in FIG. 14, the wheel assemblies come into contact with the panel 110, but it is the cable that continues to transfer the force generated by the pulling of dent, to the undamaged portion of the panel. At this point the cable lies straight across the surface of the dent. The cable acts as a sensing means to indicate how far the dent has been pulled upwardly. For example, in FIG. 14, the right side of the dent is almost pulled up flush with the dent and once this portion of the dent has been pulled flush with the cable (as seen in FIG. 15) the cutting members stop gripping the stud and begin cutting the stud, so that the right side of the dent is no longer pulled upwardly while the remainder of the dent continues to be pulled. During the cutting process, pulling force is transferred to the portion of the panel surrounding the stud. Continued pulling of the dent is shown in FIG. 15 where the right side stud is actually cut. FIG. 18 shows the Y side view of the tool as the studs are being cut.

Figure 16:
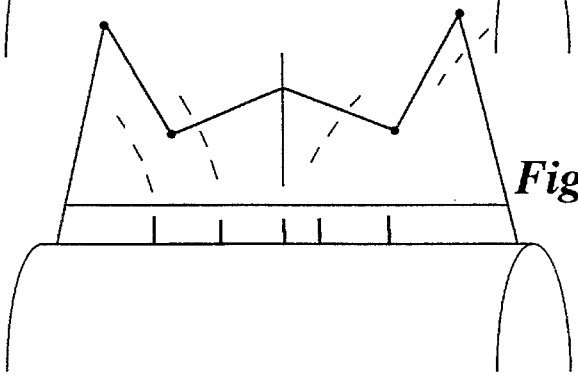
Figure 19:
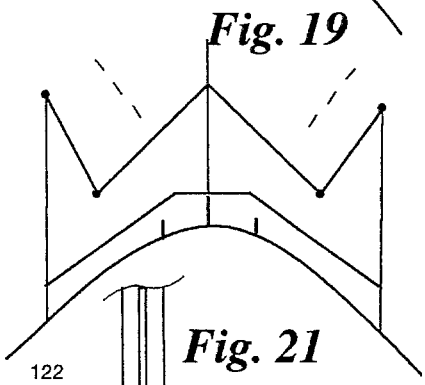

Throughout the pulling process the continuous cable is transferred between the X-axis (as best seen in FIGS. 12–16) and the Y-axis (as seen in FIGS. 17–19). Initially, as seen in FIGS. 13 and 17, there is a greater length of cable disposed along the Y-axis defined by the path of the cable over the pulleys 18 and beneath the Y-leg 4. A shorter length of the primary cable is disposed along the X-axis defined by the path of the cable over the pulleys and beneath the X-leg 2, shown in FIG. 13. As the dent is progressively pulled, however, the cable is transferred by the transfer assembly from the Y-axis to the X-axis until the dent is fully pulled, as shown in FIGS. 16 and 19. In this position a significantly greater length of the primary cable is disposed upon the X-axis (FIG. 16) than the Y-axis (FIG. 19). The transfer of cable between these two axes is very important in certain pulling applications, especially for dramatically curved surfaces such as the one shown in the present example depicted in FIGS. 12–19.

Continued rotation of the screw will cause the entire dent to be pulled flush with cable 14. Once the final stud has been cut the tool is released from the panel. At this point, the dent has been fully pulled and the panel has significantly reformed to its original shape.

Figure 22:
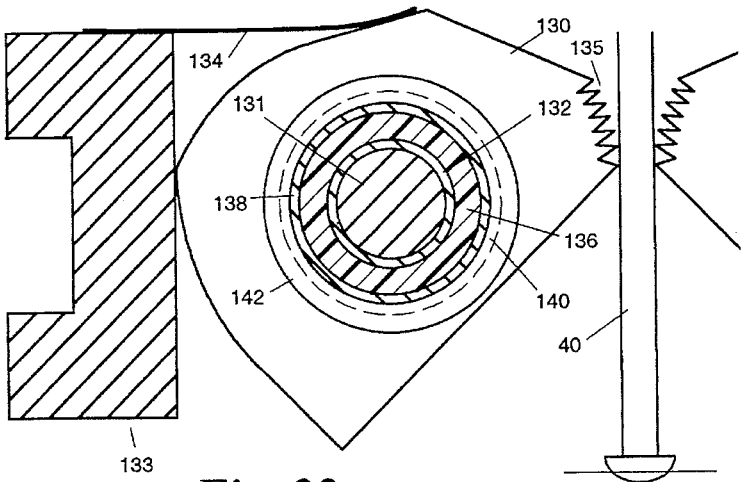
FIG. 22 shows a first cross,sectional view of a second embodiment of the stud pulling members.
Figure 23:
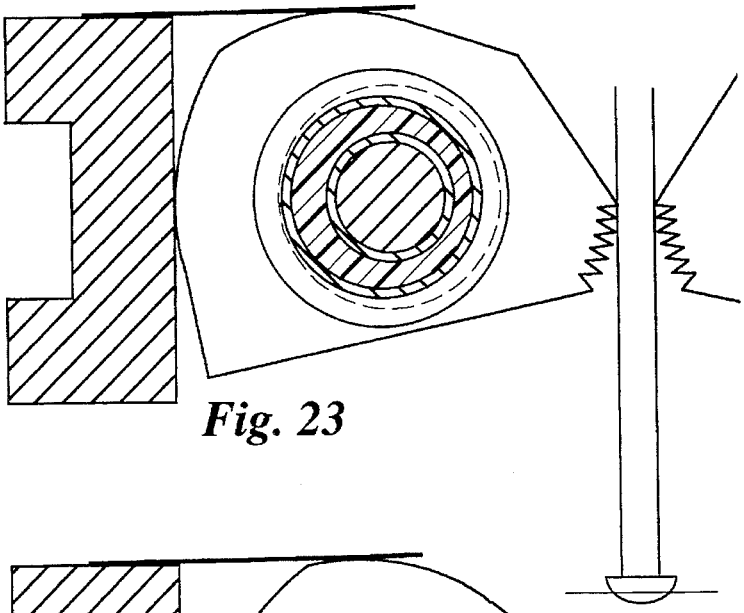
FIG. 23 shows a second sequential cross-sectional view of the second embodiment shown in FIG. 22.
Figure 24:
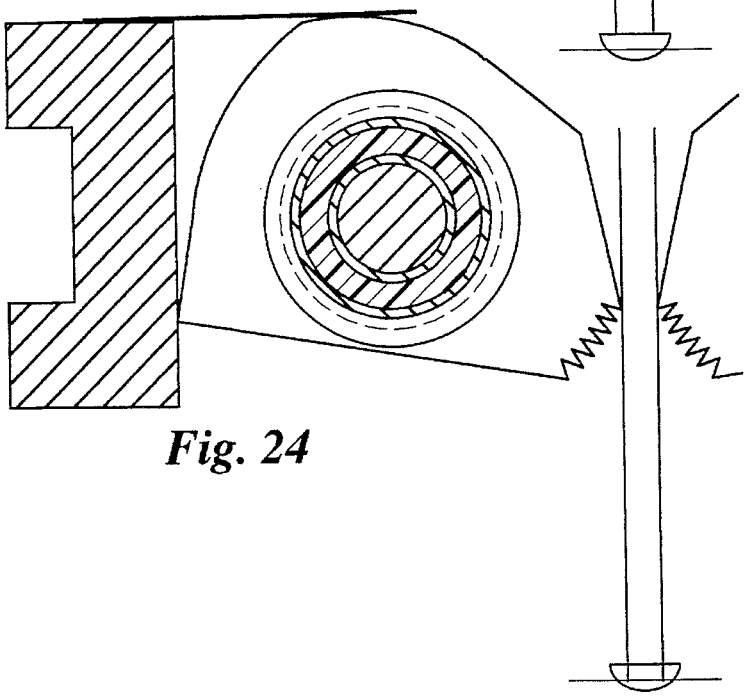
FIG. 24 shows a second sequential cross-sectional view of the second embodiment shown in FIG. 22.

One of the primary aspects of the invention is that by the independent release of the studs that are welded to the panel, the tool pulls the entire dent much more evenly without any further distortion of the panel. In the first embodiment of FIGS. 1–11, the studs are cut once the dented surface reaches the original curve of the panel. However, the cutting members could be substituted with gripping members that release the hold on the stud once the panel reaches the original curvature. FIGS. 22–24 show three sequential views of the gripping member embodiment of the invention.

Similar to the cutting members of the first embodiment, plural pairs of gripping members 130 are mounted for rotation about solid cylindrical pivot rods 131 between channel members 133, and are biased by a leaf spring 134 positioned atop of the gripping members. In this case, the ends of the gripping members are formed with serration 135 which will grip the external surface of the stud, as the panel is being pulled upwardly, as shown in FIGS. 22 and 23. But, once the panel has been pulled upward to its original shape, the gripping members will release the stud by an over-center movement of the gripping member, as shown in FIG. 24. The over-center movement is achieved by a floating mount of the gripping member 130 upon the pivot rod 131. The floating mount comprises a flexible bushing 136 disposed between a first rigid bushing 132 rotatable about the pivot rod and a second rigid bushing 138 integrally formed with the gripping member. A separate washer 140 (hidden in these views and shown by a dashed line) is disposed about the pivot rod 131. The washer is free to float within a recess 142 formed within the end of the gripping member. The washer separates the bushings disposed within adjoining gripping members.

In operation, the serration 135 will frictionally dig into the surface of the stud 40, as in FIG. 22. As the frame members 133 are lifted, the gripping members will consequently pull the stud 40 and the panel connected thereto, upwardly, as shown in FIG. 22. During this pulling process, the gripping member will begin to rotate upon the pivot rod 131. The bushing will also be compressed as the gripping member rotates. Once the dent is fully pulled upwardly, the force upon the gripping member from the pull of the frame members 133 will exceed the force of the teeth upon the stud. At this point the gripping members will move over center to release the hold of the teeth upon the stud. Thereafter, the gripping member will be free to frictionally slide along the external surface of the studs for tool removal.

The rotation of the gripping members to the over center movement can be designed to occur over an extended period of time. As mentioned above for the cutting member embodiment of FIGS. 1–11, a predetermined time delay to assist in holding the metal and in stabilizing the metal can be beneficial during the pulling process. The gripping member embodiment of FIGS. 22–24 has even more flexiblility in allowing for an extended time delay to hold the metal in place while the tool continues to pull the other studs upwardly.

There are many variations and modifications of the tool of the present invention which would still fall within the scope of the present invention. A relatively simple modification involves the reduction of legs from four to two. This embodiment is generally shaped as an inverted V. The tool is simpler than the tool described above, because the tool doesn't require the continuous cable to transfer its length between two different axes since there are only two legs upon a single axis in this simpler version of the invention. Similar to the four leg version of the invention, a cable tensioning device can be used to adjust the tension along the primary cable which is disposed beneath the two legs in parallel portions. Such a tool would still have the capability of adapting to a curved surface, as well as providing an independent release of the studs as they are pulled up flush with the primary cable.

Modification of the release members can be used to customize the tool in different pulling applications. For example, in the gripping member embodiment, a higher or lower durometer material can be used for the flexible bushing depending upon whether heavy or light gauge metal is to be pulled, respectively. Similarly, in the cutting member embodiment, the cutting members can be formed at a sharper angle for lighter gauge metals The invention in its most basic form involves a flexible base member with a plural point pulling mechanism. In other words, several points within a dent of a panel are marked, and a pulling mechanism is attached at these discreet points. In the embodiments noted above, studs are welded to the panel at these points. However, other ways of attaching a pulling mechanism could involve drilling holes in the panel at these points and attaching hooks through the drilled holes. The flexible base member in the embodiments noted above is the primary cable. But clearly the cable could be replaced with a flexible belt. One important aspect of the invention involves the pulling of the dent up to the flexible base member. As stated earlier, the flexible base member serves two unique purposes. First, it forms a stopping point at which the dent can no longer be pulled upwardly. Second, the flexible base member distributes resistance evenly across the undamaged portions of the dent.

A very basic method of repairing dents is known where a rigid base member covers the dented portion of the panel, and the dent is pulled or pounded out to the rigid base member. Many problems arise when using this basic method of repairing dents. First, the rigid and flat base member does not allow proper repair of curved panels since the base member cannot flex and conform to a curved surface, as the flexible member does in the present invention. Second, a rigid base member will not distribute resistance as effectively as a flexible member which can cause secondary damage to the panel during the pulling or pounding of the dent. Third, a rigid base member won't allow hinged legs to extend down into a dent to attach the legs to points within the dent.

Another fundamental aspect of the invention is the independent release of selected points attached to the dent. Once the pulling mechanism is attached to the dented panel at a plurality of points, the tool of the present invention lifts all points simultaneously during the pulling process and releases the points independently so that one point of the dent isn't pulled too far while another point of the dent isn't pulled far enough. The embodiments noted above use independent acting cutting or gripping members mounted upon either two or four independently moving legs. There are many different ways that an independent release mechanism could be achieved that would still be encompassed by the scope of the present invention.

Yet, another fundamental aspect of the invention is the stabilization of the metal as the dent is being pulled upwardly. Once a portion of the dent has been pulled up to the flexible base member and draws the metal about the stud into a slight bump, that portion of the metal is stabilized as the tool continues to pull the remainder of the dent. The slight bump acts as a shrinking mechanism for the metal surrounding the stud. Gradually, more metal is stabilized as it is pulled up into contact with the cable. This gradual stabilization of all of the metal within the dent will minimize the amount of additional work required to straighten and smooth the dent. The stabilization process is further enhanced by the slow release of the stud. In both embodiments described, the release of the stud is not immediate once the metal contacts the cable. Instead, the cutting of the stud by the cutting member embodiment and movement over-center of gripping member embodiment provides for a relatively slow release of the stud. This allows for additional metal to be pulled up around the soon-to-be released stud to provide for additional stabilization of the metal. Such a delayed release will prevent spring back of the pulled metal which usually occurs when using conventional metal pulling technology.

It should be apparent that all of the modifications, stated above, as well as many other modifications could be made to the tool and process of the present invention which would still be encompassed within the scope of the present invention. It is intended that all such modifications may fall within the scope of the appended claims.

What is claimed is:

1. A tool for reducing the depth of concavity of a concave portion within a panel, comprising:

a plurality of connecting members to allow said tool to be connected to a plurality of points upon the concave portion;

a means for pulling each of said plurality of connecting members;

a means for triggering a release of the connection of each of said connecting members from the concave portion in response to a predetermined condition, said means for triggering a release allowing for a release of a connecting member that is independent in time from the release of another connecting member;

wherein said predetermined condition is defined by the surface of the concave portion reaching a desired depth.

2. A tool as claimed in claim 1, wherein, said tool further comprising means for holding one of said connecting members at said desired depth for a predetermined time delay prior to a release of the connection of said one member with the concave portion of the panel.

3. A tool as claimed in claim 1, wherein, each of said plurality of connecting members comprise a gripping member for contacting and frictionally holding a stud attached to the concave portion of the panel, each of said gripping members further comprising means for releasing the stud.

4. A tool as claimed in claim 1, wherein, each of said plurality of connecting members comprise a cutting member for contacting and frictionally holding a stud attached to the concave portion of the panel, each of said cutting members further comprising an edge for severing the stud to achieve the release of said cutting member from the stud.

5. A tool as claimed in claim 1, wherein, said plurality of connecting members are mounted upon at least one leg member, movement of said at least one leg member causing said plurality of points of said concave portion to raise upwardly.

6. A tool as claimed in claim 5, wherein, said at least one leg member comprising first and second hinged leg members generally aligned along a first axis, and, third and fourth hinged leg members generally aligned along a second axis.

7. A tool as claimed in claim 5, wherein, said means for pulling each of said connecting members generating a pulling force due to the pull upon said connecting members;

said tool further comprises a means for transferring said pulling force to a continuous line of the panel extending between the perimeter of the concave portion to a point where an end of said leg member contacts against the panel outside of the concave portion.

8. A tool as claimed in claim 7, wherein, said means for transferring said pulling force comprises a flexible cable stretching across the concave portion to said end of said leg member.

9. A tool for reducing the depth of concavity of a concave portion within a panel, comprising:

a plurality of connecting members to allow said tool to be connected to a plurality of points upon the concave portion;

a means for pulling each of said plurality of connecting members;

a means for transferring the force generated by the pulling of said connecting members to a wide continuous area outside of said concave portion of the panel;

a means for releasing the connection of each said connecting members from the concave portion in response to a predetermined condition, said predetermined condition is defined by the surface of the concave portion reaching a desired depth, said releasing means being a severance of said connecting members in response to said connecting members reaching said predetermined condition;

a means for holding each of said plurality of connecting members at said desired depth for a predetermined time delay prior to a release of the connection of each of said members with the concave portion of the panel, said tool allowing for varying predetermined time delays for each of said connecting members.

10. A tool for moving a concave portion of a panel to a predetermined profile, comprising:

a flexible base member for spanning across the width of the concave portion, and capable of bending into the predetermined profile;

a member for connecting said tool to at least one point within the concave portion of the panel;

a means for moving said member so that the point of the concave portion of the panel directly contacts said flexible base member to substantially form the predetermined profile.

11. A tool as claimed in claim 10, wherein, said flexible base member comprises a continuous loop of cable mounted and guided upon a plurality of pulley members.

12. A tool as claimed in claim 10, wherein, aid flexible base member is provided with a means to allow said base member to stretch to a predetermined length.

13. A method for pulling a concave portion of a panel outwardly, comprising the steps of:

a first step of defining a plurality of points upon the surface of the concave portion of the panel;

a second step of selecting a tool capable of reducing the depth of concavity on a concave portion of a panel, said tool including a plurality of connecting members to allow said tool to be connected to a plurality of points upon the concave portion, a means for pulling each of said plurality of connecting members, a means for triggering a release of the connection of each of said connecting members from the concave portion in response to a predetermined condition, said means for triggering a release allowing for a release of a connecting member that is independent in time from the release of another connecting member;

a third step of aligning said tool over the concave portion of the panel;

a fourth step of gripping each of said points upon the panel with said connecting members on said tool;

a fifth step of using said means for pulling located on said tool to pull upon each of said points;

a sixth step of using said means for triggering to independently release each of said points in response to a predetermined condition;

wherein said predetermined condition is defined by the surface of the concave portion reaching a desired depth.

14. A method as claimed in claim 13, wherein said fifth step comprises a substep of transferring the force generated by the pulling of said points to a wide continuous area outside of said concave portion of the panel.

15. A method as claimed in claim 13, wherein said sixth step comprising a substep of holding each of said points for a predetermined time delay prior to said independent release.

* * * * *